US010793939B2

(12) United States Patent
Shah et al.

(10) Patent No.: US 10,793,939 B2
(45) Date of Patent: Oct. 6, 2020

(54) NICKEL BASED SUPERALLOY WITH HIGH VOLUME FRACTION OF PRECIPITATE PHASE

(71) Applicant: United Technologies Corporation, Farmington, CT (US)

(72) Inventors: Dilip M. Shah, Glastonbury, CT (US); Alan D. Cetel, West Hartford, CT (US); Venkatarama K. Seetharaman, Rocky Hill, CT (US)

(73) Assignee: United Technologies Coporation, Farmington, CT (US)

( * ) Notice: Subject to any disclaimer, the term of this patent is extended or adjusted under 35 U.S.C. 154(b) by 123 days.

(21) Appl. No.: 16/214,715

(22) Filed: Dec. 10, 2018

(65) Prior Publication Data

US 2020/0024716 A1 Jan. 23, 2020

Related U.S. Application Data

(62) Division of application No. 14/867,232, filed on Sep. 28, 2015, now Pat. No. 10,301,711.

(51) Int. Cl.
*C22C 19/05* (2006.01)
*C22F 1/10* (2006.01)

(52) U.S. Cl.
CPC ..... *C22F 1/10* (2013.01); *C22C 19/056* (2013.01)

(58) Field of Classification Search
CPC ..... C22F 1/10; C22C 19/056; C22C 19/053; C22C 19/057; C22C 19/055
See application file for complete search history.

(56) References Cited

U.S. PATENT DOCUMENTS

| | | | | |
|---|---|---|---|---|
| 4,514,360 | A | 4/1985 | Giamei et al. | |
| 4,574,015 | A | 3/1986 | Genereux et al. | |
| 4,769,087 | A | 9/1988 | Genereux et al. | |
| 5,665,180 | A | 9/1997 | Seetharaman et al. | |
| 6,132,527 | A * | 10/2000 | Hessell ..... | C22C 19/056 148/410 |
| 7,115,175 | B2 | 10/2006 | DeLuca et al. | |

FOREIGN PATENT DOCUMENTS

EP 0248757 A1 12/1987

OTHER PUBLICATIONS

S. Zhao, X. Xie, G.D. Smith, S.J. Patel, Gamma prime coarsening and age-hardening behaviors in a new nickel base superalloy Mater. Lett., 58 (2004), pp. 1784-1787.*
Application Example: Reverse Engineering, Aerospace: Upgrade of a Black Hawk HelicopterGOM Optical Measuring Techniques; www.gom.com; 2008.GOM.MbH.

* cited by examiner

*Primary Examiner* — Jessee R Roe
(74) *Attorney, Agent, or Firm* — Bachman & LaPointe, P.C.

(57) ABSTRACT

A process includes solution heat treating a nickel based superalloy with greater than about 40% by volume of gamma prime precipitate to dissolve the gamma prime precipitate in the nickel based superalloy; cooling the nickel based superalloy to about 85% of a solution temperature measured on an absolute scale to coarsen the gamma prime precipitate such that a precipitate structure is greater than about 0.7 micron size; and wrought processing the nickel based superalloy at a temperature below a recrystallization temperature of the nickel based superalloy. A material includes a nickel based superalloy with greater than about 40% by volume of gamma prime precipitate in which the precipitate structure is greater than about 0.7 micron size.

5 Claims, 5 Drawing Sheets

Typical Single Crystal Alloy Solution Heat
Treated at 2400°F/30 min+ 0.3F/min to 2000°F Typical Single Crystal Alloy Solution Heat
Treated at 2400°F 0.3F/min to 2250°F/24 hrs

NICKEL BASED SUPERALLOY WITH HIGH VOLUME FRACTION OF PRECIPITATE PHASE

CROSS-REFERENCE TO RELATED APPLICATION

The instant application is a divisional application of U.S. patent application Ser. No. 14/867,232 filed Sep. 28, 2015.

BACKGROUND

The present disclosure relates to nickel based superalloy materials and, more particularly, to the preparation of a nickel based superalloy in which the coarse precipitate structure facilitates wrought processes and precipitation hardening is not re-invoked.

Nickel based superalloys are widely used in gas turbine engines such as in turbine rotor disks. The property requirements for such rotor disk materials have increased with the general progression in engine performance. Early engines utilized relatively easily forged steel and steel derivative alloys as the rotor disk materials. These were then supplanted by first generation nickel based superalloys, such as age hardening austenitic (face-centered cubic) nickel-based superalloys, which were capable of being forged, albeit often with some difficulty.

Nickel based superalloys derive much of their strength from the gamma prime [$Ni_3(Al,X)$] phase. The trend has been toward an increase in the gamma prime volume fraction for increased strength. The nickel based superalloy used in the early disk alloys contain about 25% by volume of the gamma prime phase, whereas more recently developed disk alloys contain about 40-70%.

Alloys containing relatively high volume fractions of the gamma prime precipitates, however, is not considered readily amenable to wrought processes such as rolling, swaging, forging, extrusion and variants thereof, unless the material has a fine grain structure. Alloys with coarse grain structure, or single crystal structures, are thus over-aged to coarsen the precipitates, and then some amount of warm working is imparted to the resulting softened material. However, even where practiced, it is conventionally believed that the resulting material may not have sufficient strength and it is absolutely necessary to re-solution all the gamma prime precipitates in the material and perform precipitation heat treatment to achieve reasonable strength.

Currently, solid solution hardened or low gamma prime (y') volume fraction alloys are utilized for most high strength applications as the wrought processing pathway for precipitation hardened alloys is considered relatively difficult and expensive.

SUMMARY

A process according to one disclosed non-limiting embodiment of the present disclosure can include solution heat treating a nickel based superalloy with greater than about 40% by volume of gamma prime precipitate to dissolve the gamma prime precipitate in the nickel based superalloy; cooling the nickel based superalloy to about 85% of a solution temperature measured on an absolute scale to coarsen the gamma prime precipitate such that a precipitate structure is greater than about 0.7 micron size; and wrought processing the nickel based superalloy at a temperature below a recrystallization temperature of the nickel based superalloy.

A further embodiment of the present disclosure may include, wherein the nickel based superalloy includes at least 50% by volume of gamma prime precipitate.

A further embodiment of any of the embodiments of the present disclosure may include, wherein the cooling is performed at a rate slower than about 10° F./minute.

A further embodiment of any of the embodiments of the present disclosure may include, wherein the cooling is a rapid cooling, then the temperature held for a period of time until the precipitate structure is greater than about 0.7 micron size.

A further embodiment of any of the embodiments of the present disclosure may include, wherein the wrought processing includes at least one of swaging, rolling, ring-rolling, forging, extruding, and shape forming operations.

A further embodiment of any of the embodiments of the present disclosure may include annealing intermittently at temperatures no higher than the recrystallization temperature subsequent to the wrought processing to partially recover dislocation structure.

A further embodiment of any of the embodiments of the present disclosure may include, wherein the recrystallization temperature has an upper limit of about 90% of a solution temperature measured on an absolute scale.

A further embodiment of any of the embodiments of the present disclosure may include heat treating at temperatures no higher than the recrystallization temperature subsequent to the wrought processing.

A further embodiment of any of the embodiments of the present disclosure may include, wherein the recrystallization temperature has an upper limit of about 90% of a solution temperature measured on an absolute scale.

A further embodiment of any of the embodiments of the present disclosure may include, wherein no additional precipitation is performed to the nickel based superalloy subsequent to the wrought processing.

A further embodiment of any of the embodiments of the present disclosure may include, wherein no additional heat treating is performed to the nickel based superalloy subsequent to the wrought processing.

A further embodiment of any of the embodiments of the present disclosure may include, wherein the nickel based superalloy is subjected to a solution heat treatment and slow cooled.

A further embodiment of any of the embodiments of the present disclosure may include, wherein the nickel based superalloy is subjected to a sub-solution temperature annealing cycle.

A further embodiment of any of the embodiments of the present disclosure may include, wherein the nickel based superalloy is subjected to isothermal over-aging.

A material according to another disclosed non-limiting embodiment of the present disclosure can include a nickel based superalloy with greater than about 40% by volume of gamma prime precipitate in which the precipitate structure is greater than about 0.7 micron size.

A further embodiment of any of the embodiments of the present disclosure may include, wherein the nickel based superalloy includes about 50% by volume of gamma prime precipitate.

A further embodiment of any of the embodiments of the present disclosure may include, wherein the nickel based superalloy has been subjected to isothermal over-aging.

A further embodiment of any of the embodiments of the present disclosure may include, wherein the nickel based superalloy has been subjected to a wrought process.

A further embodiment of any of the embodiments of the present disclosure may include, wherein the nickel based superalloy has been subjected to a solution heat treatment and a low temperate heat treatment.

A further embodiment of any of the embodiments of the present disclosure may include, wherein the nickel based superalloy includes rhenium and about 8-12.5% tantalum.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
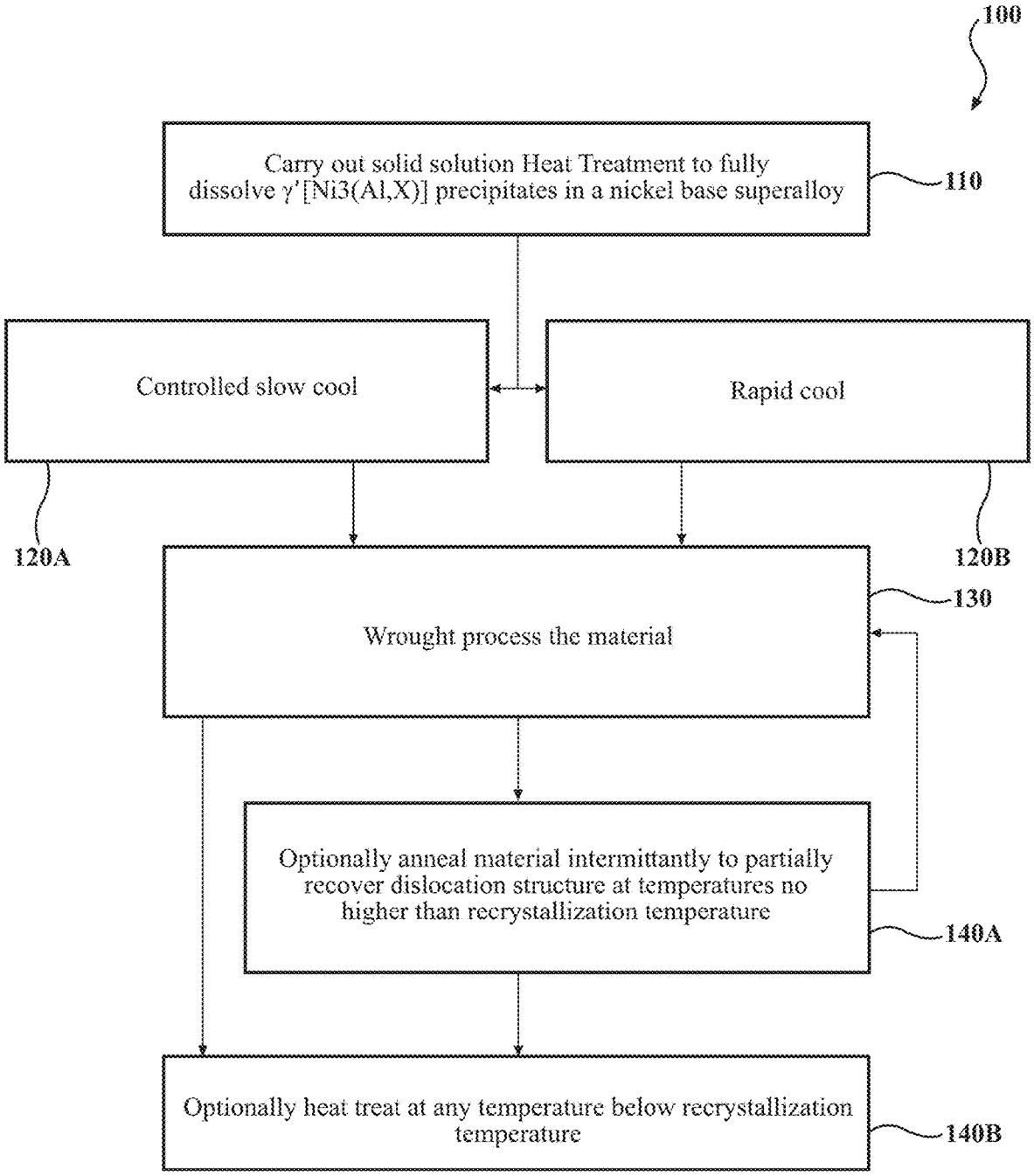
FIG. 1 is a block diagram of a process according to one disclosed non-limiting embodiment in which a nickel based superalloy with greater than about 40% by volume of gamma prime precipitate is solution heat treated and slow cooled, or subjected to a sub-solution temperature annealing cycle, to produce an extremely coarse precipitate structure.
Figure 2A:
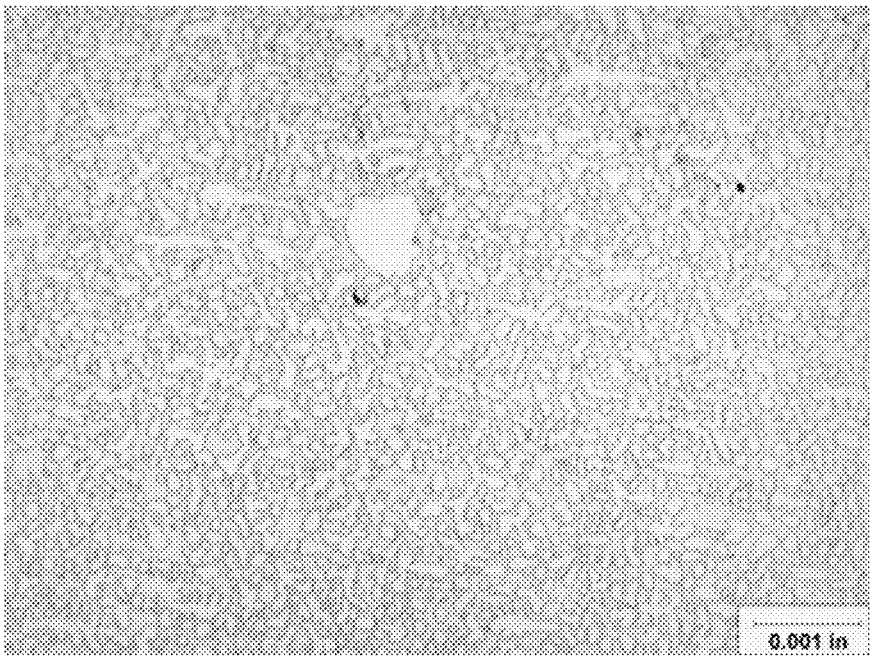
FIG. 2A is a micrograph of an example Single Crystal Alloy Solution Heat Treated at 2400° F./30 min+0.3° F./min to 2000° F. as formed by the process disclosed herein.
Figure 2B:
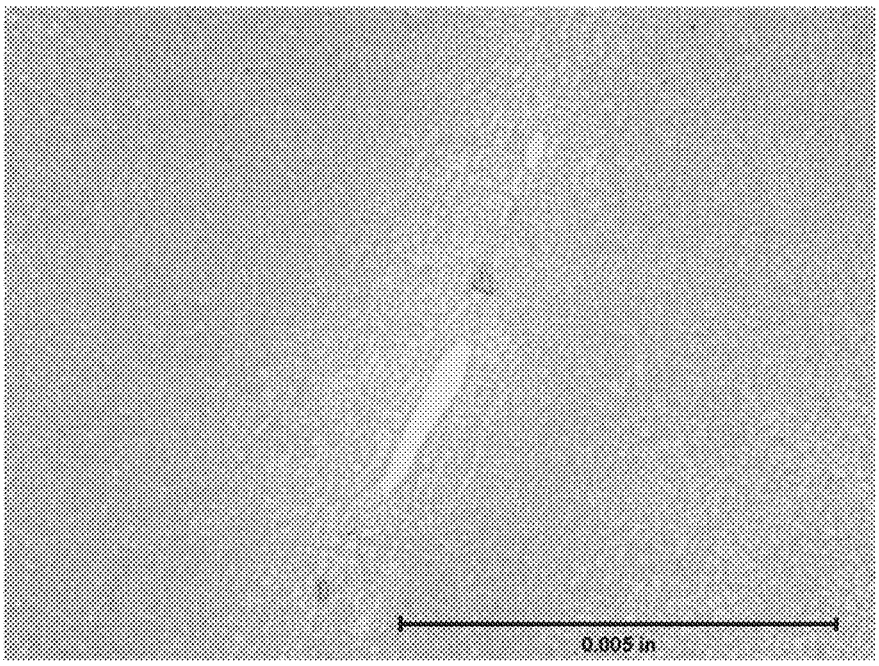
FIG. 2B is a micrograph of an example Single Crystal Alloy Solution Heat Treated at 2400° F./30 min+0.3° F./min to 2250° F./24 hours as formed by the process disclosed herein.

With reference to FIG. 1, one disclosed non-limiting embodiment of a process 100 in which a nickel based superalloy with greater than about 40% by volume of gamma prime precipitate is solution heat treated and slow cooled, or subjected to a sub-solution temperature annealing cycle, to produce an extremely coarse precipitate structure of greater than about 0.7 microns (~0.000027559 inches) size (see, FIGS. 2A, 2B). This is otherwise counterintuitive since it has not heretofore been considered beneficial to relinquish precipitation hardening as a strengthening mechanism for precipitation hardenable alloys.

The two micrographs are a result of a slow cool (FIG. 2A) or long high temperature isothermal heat treatment (FIG. 2B). The island-like structures that appear in the micrographs are the gamma prime precipitates that facilitates the wrought process as it results in a relatively softer material that starts and ends with this microstructure that, with cold or warm work producing high dislocation density results in high strength. In conventional heat-treated materials the gamma prime precipitates cannot be easily resolved under an optical microscope as typical size will be about 0.5 microns (~19.7 microinch). In such a case an electron microscope is required to resolve reveal the gamma prime precipitates. In electron microscope these typical gamma prime precipitates appear as well organized cubes with very little spacing between them in which the strength thereof comes from an organized arrangement of fine precipitates. The process 100 essentially coarsens these precipitates to soften the material and then strength is restored through a wrought process.

Initially, the nickel based superalloy is solid solution heat treated to fully dissolve the gamma prime [$Ni_3(Al,X)$] precipitates in the nickel based superalloy (step 110). In one embodiment, the nickel based superalloy may include at least 40% by volume of gamma prime precipitate. In another embodiment, the nickel based superalloy includes about 50% by volume of gamma prime precipitate, and refractory elements such as rhenium, and a relatively high level (8%-12.5%) of tantalum. Alternately, the disclosed process 100 may be applied to fine grained powder metallurgy ("P/M") or cast equiaxed material.

Next, after the hot or cold forming process, the nickel based alloy may be subjected to a low temperature precipitation hardening process, as desired, to further enhance the strength or lock-in the dislocation structure for stability such that the gamma prime is coarsened to be greater than about 0.7 microns. In one embodiment, the nickel based superalloy is subjected to a controlled slow cool at a rate slower than about 10° F. per minute to around 85% of the solution temperature measured on an absolute scale of K or ° R and held for greater than about two (2) hours, to coarsen the gamma prime to be greater than about 0.7 microns (step 120A). Alternatively, in another embodiment, the nickel based superalloy is subjected to rapid cooling to some temperature at or above 85% of the solution temperature measured on an absolute scale of K or ° R and held for greater than about two (2) hours, to coarsen the gamma prime to be greater than about 0.7 microns (step 120B).

Next, the nickel based superalloy is subjected to wrought processing such as by swaging, rolling, ring-rolling, folding, extruding or other hot and cold working processes at any temperature below recrystallization temperature (step 130). It should be appreciated that any wrought process that reduces the cross-sectional area, changes the shape by bending, or other definition etc., of the nickel based superalloy may be used without departing from the scope of the disclosure. In one example, the upper limit of the recrystallization temperature is about 90% of a gamma prime solution temperature measured on an absolute scale of K or ° R.

Optionally, the material is intermittently annealed to partially recover dislocation structure at temperatures no higher than the recrystallization temperature of about 90% of a gamma prime solution temperature measured on an absolute scale of K or ° R (step 140A). Optionally still, the heat treat may be performed at any temperature below recrystallization temperature, the upper limit of which is typically around 90% of solution temperature measured on an absolute scale of K or ° R (step 140B). It should be appreciated that the recrystallization temperature is a relatively complex function of process, amount of deformation, and alloy composition, but can be tracked with techniques such as simple metallography, X-ray diffraction, or orientation imaging microscopy. The recrystallization can even occur at room temperature if excessive deformation is imparted.

Contrary to conventional practices, data shows that material manufactured by the process 100 retains sufficient creep resistance and a stable microstructure with improved fatigue life to be a useful structural material that can be employed in service for several hundred hours at temperatures up to its recrystallization temperature, which, in some advanced single crystal alloys, is as high as 2100° F. The coarse precipitate microstructure is uniquely characteristic of this process. That is, unusually high tensile yield strength in excess of 200 ksi, and ultimate tensile strength (UTS) in excess of 250 ksi at 1000° F., can be readily achieved in single crystal alloys, while maintaining reasonable ductility of 5% or higher. Based on similar data for two widely different alloy compositions, it is believed that this is not a unique characteristic of a specific alloy but a result of the over-aging heat treatment process followed by warm working.

Metallurgically, the coarse precipitate structure essentially opens the gamma channels of the ductile solid solution matrix phase, increasing ductility and allowing the material to be warm worked without cracking. The resulting dislocation structure leads to achievement of extremely high tensile strength (FIGS. 3A-3D). Relinquishing precipitation hardening as a strengthening mechanism in a wrought precipitation hardened alloy to yield a significant strength enhancement is an unexpected benefit of the process 100.

The process 100 reveals that in superalloys with certain volume fraction of precipitates, low temperature (~1000° F.) strength is actually not sensitive to the alloy composition. For example, cast single crystal PWA 1484 is an advanced single crystal creep resistant alloy, whereas UDIMET® 720 LI is a fine-grained alloy that is a relatively less creep resistant, and yet, in both cases, comparable strength is achieved via the disclosed process 100. Further strength may be achieved via the disclosed process 100 with a lower temperature (~1300-1600° F.) aging heat treatment.

Figure 3A:
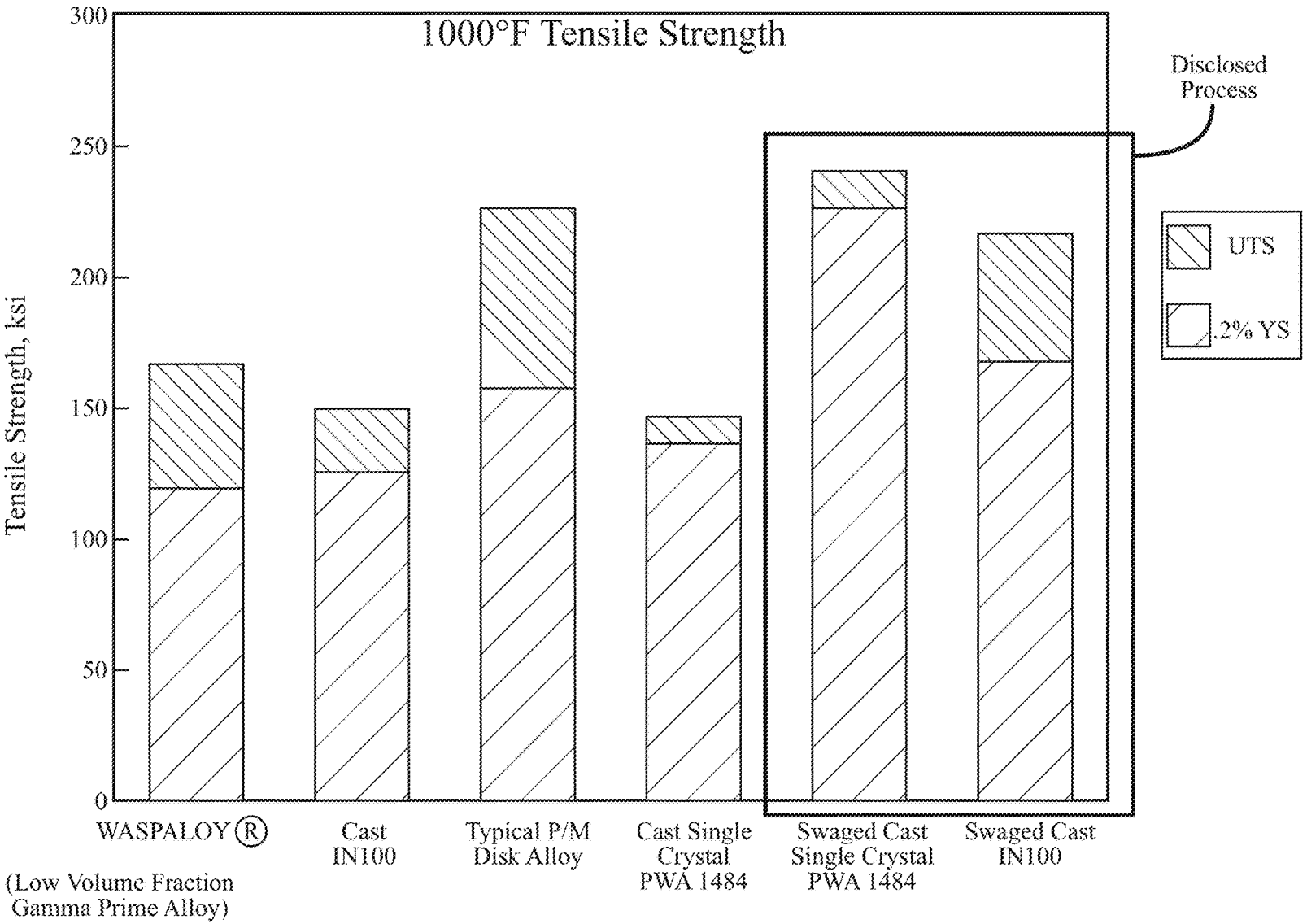
FIG. 3A is a representative comparison of the 0.2% yield strength data obtained at 1000° F. for wrought WASPALOY®, cast IN100, typical P/M disk alloy, cast single crystal PWA 1484, swaged cast single crystal PWA 1484, and swaged cast IN100 alloy.
Figure 3C:
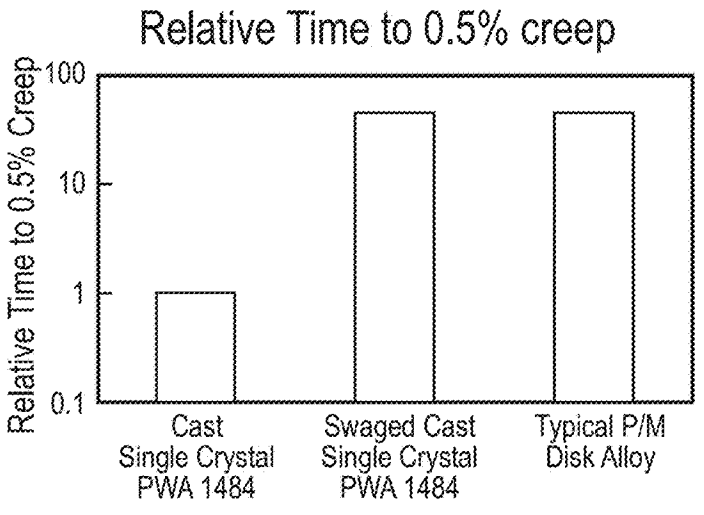
FIG. 3C is a representative relative comparison of time to 0.5% creep for cast single crystal PWA 1484, swaged cast single crystal PWA 1484, and a typical P/M disk alloy.
Figure 3B:
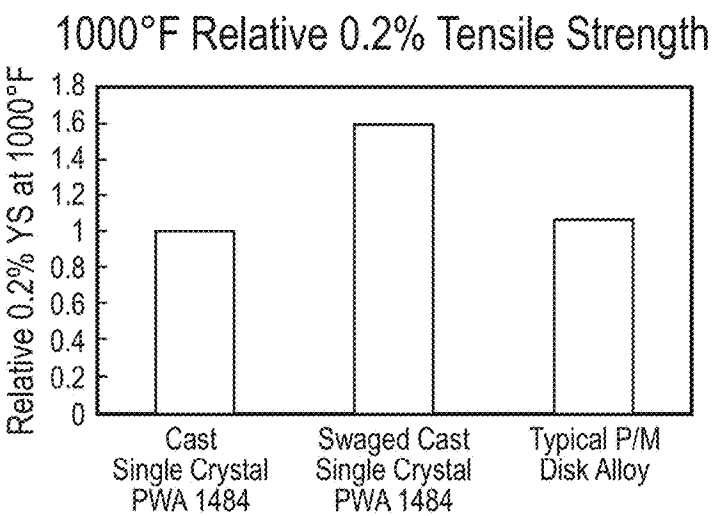
FIG. 3B is a representative relative comparison of the 0.2% yield strength, for cast single crystal PWA 1484, swaged cast single crystal PWA 1484, and a typical P/M disk alloy.
Figure 3D:
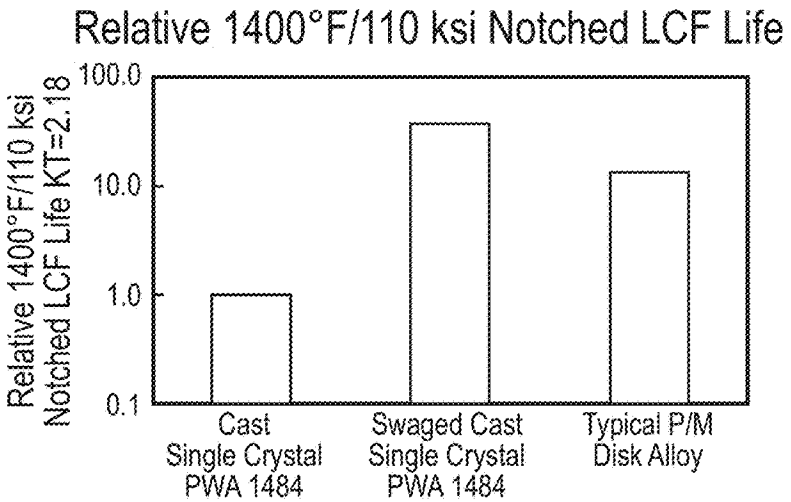
FIG. 3D is a representative relative notched Low Cycle Fatigue (LCF) life comparison for cast single crystal PWA 1484, swaged cast single crystal PWA 1484, and a typical P/M disk alloy.

FIG. 3A provides a representative comparison of the 0.2% yield strength data obtained at 1000° F. for wrought WASPALOY®, cast IN100, typical P/M disk alloy, cast single crystal PWA 1484, swaged cast single crystal PWA 1484, and swaged cast IN100 alloy. The swaged cast IN100 is a cast equiaxed material with the coarse precipitate structure that has been subjected to a hot swaging process. The swaged cast single crystal PWA 1484 is an advanced creep resistant single crystal alloy that has been subjected to a hot swaging process. The swaged cast single crystal PWA 1484, and swaged cast IN100 alloy manufactured in accords with the disclosed process 100 indicate an increase in 0.2% yield strength and Ultimate Tensile Strength (UTS). Furthermore, the swaged cast single crystal PWA 1484, for example, beneficially provides an increase in 0.2% yield strength (FIG. 3B), a relative time to 0.5% creep (FIG. 3C), and a notched Low Cycle Fatigue (LCF) life (FIG. 3D) compared to the cast single crystal PWA 1484, and a typical P/M disk alloy.

It should be appreciated that it is conventionally understood that to achieve high strength, it is essential to have a fine grain structure and the material must have fine gamma prime precipitate structure restored. In fact, minor composition changes are conventionally performed to achieve these properties compared to a cast version of the alloy. The conventional approach requires re-solutioning of relatively massive components in practice, then quenching of such parts. The conventional powder metallurgical approach is relatively expensive which precludes application to secondary components that may also benefit from high strength, such as nuts and bolts. In contrast, the disclosed process eliminates such cumbersome steps and indicates that neither extremely fine grain structure, nor fine precipitate structure, is necessary to achieve high strength.

Currently, the bore of a gas turbine engine rotor disk, which requires high strength, is subjected to a re-solutioning and quenching cycle to restore strength. This may be cumbersome and costly. Application of the disclosed process 100, with creep-resistant single crystal type alloys, facilitates unprecedented high strength in the disk bore. This may be particularly useful for relatively small core gas turbine engine designs and may lead to significant weight reduction.

In addition, many secondary components such as nuts, bolts, tie-rods, W-seals, etc., are produced using non-precipitation hardened alloys or alloys with low volume fraction of precipitates, but the high tensile strength associated with these alloys is erroneously assumed to be a characteristic of the specific alloy compositions. Such secondary components can be readily manufactured of precipitation-hardened alloys with comparable high tensile properties according to the process 100 to provide improved temperature capability, oxidation resistance, and durability. Similarly, there are many applications, for example aircraft landing gear, that require specialized steels such as maraging steel and trip steels, where high tensile strengths are assumed to be unique to these specific alloys. As such, the disclosed process 100 will facilitate usage of precipitation hardened alloys with comparable high tensile properties to provide a unique combination of high tensile strength and high temperature capability without resorting to such specialized steels.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to normal operational attitude and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed:

1. A material, comprising:

a nickel based superalloy with greater than about 40% by volume of gamma prime precipitate in which the precipitate structure is greater than about 0.7 micron size, wherein the nickel based superalloy includes rhenium and about 8-12.5% tantalum.

2. The material as recited in claim 1, wherein the nickel based superalloy includes about 50% by volume of gamma prime precipitate.

3. The material as recited in claim 1, wherein the nickel based superalloy has been subjected to isothermal overaging.

4. The material as recited in claim 1, wherein the nickel based superalloy has been subjected to a wrought process.

5. The material as recited in claim 1, wherein the nickel based superalloy has been subjected to a solution heat treatment and a low temperate heat treatment.

* * * * *